US009882292B2

(12) United States Patent
Koto

(10) Patent No.: US 9,882,292 B2
(45) Date of Patent: Jan. 30, 2018

(54) INTER-WIRE CONNECTION STRUCTURE AND METHOD FOR MANUFACTURING THE SAME

(75) Inventor: Naoki Koto, Makinohara (JP)

(73) Assignee: YAZAKI CORPORATION, Mintao-ku, Tokyo (JP)

( * ) Notice: Subject to any disclaimer, the term of this patent is extended or adjusted under 35 U.S.C. 154(b) by 407 days.

(21) Appl. No.: 13/495,789

(22) Filed: Jun. 13, 2012

(65) Prior Publication Data

US 2012/0318554 A1 Dec. 20, 2012

(30) Foreign Application Priority Data

Jun. 17, 2011 (JP) ..... P2011-135179

(51) Int. Cl.
*H01R 4/62* (2006.01)
*H01R 4/72* (2006.01)

(52) U.S. Cl.
CPC ..... *H01R 4/625* (2013.01); *H01R 4/72* (2013.01); *Y10T 29/49195* (2015.01)

(58) Field of Classification Search
CPC ..... H01R 43/0207; Y10T 29/49179
USPC ..... 29/877, 879, 828, 881, 882
See application file for complete search history.

(56) References Cited

U.S. PATENT DOCUMENTS 1,927,382 A * 9/1933 Andrew ..... H01R 4/186 16/108
1,953,891 A * 4/1934 Andrew ..... H01R 4/625 174/71 R
2,513,365 A * 7/1950 Rogoff ..... B23K 35/002 205/183
2,535,397 A * 12/1950 Alphonse ..... B23K 11/20 219/106

(Continued)

FOREIGN PATENT DOCUMENTS

CN 1510784 A 7/2004
CN 101141057 A 3/2008

(Continued)

OTHER PUBLICATIONS

Notification of First Office Action for Chinese Application no. 201210206472.3 dated Oct. 27, 2014 (10 pages).

(Continued)

*Primary Examiner* — Peter DungBa Vo
*Assistant Examiner* — Kaying Kue
(74) *Attorney, Agent, or Firm* — Sughrue Mion, PLLC

(57) ABSTRACT

An inter-wire connection structure includes: first and second wires connected to each other and each having a core sheathed with an insulating sheath section and including a plurality of element wires; a single-wire structure section in which the plurality of element wires of at least one of the cores exposed from the insulating sheath sections are made into a single; a core joint section in which both the cores exposed from the insulating sheath sections are joined at a (Continued)

position where an entire region of the single-wire structure section is not overlapped, and having an outer peripheral surface in a shape of a circumferential surface; and a tube tightly covering portions of the cores exposed from the insulating sheath sections including the single-wire structure section and the core joint section, and portions of the insulating sheath sections.

8 Claims, 5 Drawing Sheets

(56) References Cited

U.S. PATENT DOCUMENTS 2,768,105 A * 10/1956 Dittmore ..... H02G 1/14 156/49
3,417,195 A * 12/1968 Shlesinger, Jr. ..... H01R 3/08 174/75 R
3,525,799 A * 8/1970 Ellis ..... H01R 4/723 174/84 R
3,717,842 A * 2/1973 Douglas, Jr. ..... H01R 4/187 156/73.1
3,821,842 A * 7/1974 Bergman ..... B21F 15/02 204/192.15
3,891,790 A * 6/1975 Kierstead ..... H02G 15/1806 174/93
4,129,744 A * 12/1978 Cunningham ..... H01R 4/625 174/94 R
4,176,244 A * 11/1979 Ramy ..... H02G 15/085 174/75 C
4,995,838 A * 2/1991 Ayer ..... H01R 4/723 174/84 R
5,422,438 A * 6/1995 Lamome ..... H01R 4/203 174/76
5,584,122 A * 12/1996 Kato ..... H01R 13/5216 174/84 R
5,672,846 A * 9/1997 Marie-Louise Debbaut ..... H01B 17/60 174/76
5,857,259 A * 1/1999 Johnston ..... H01R 12/592 174/76
6,226,865 B1 * 5/2001 Tanikawa ..... B23K 20/10 174/84 R
6,239,373 B1 * 5/2001 Sato ..... H01R 4/723 174/75 C
6,393,924 B1 * 5/2002 Eder ..... B23K 20/10 73/850
6,658,735 B2 * 12/2003 Ito ..... H01R 4/183 174/84 C
6,674,007 B2 * 1/2004 Ide ..... H01B 7/0861 174/84 R
8,350,155 B2 * 1/2013 Kobayashi ..... H01R 4/186 174/84 R
2003/0094295 A1 * 5/2003 Ide ..... H01B 7/009 174/359
2004/0088857 A1 * 5/2004 Fujimoto ..... H01R 11/12 29/871
2004/0134062 A1 * 7/2004 Jonli ..... H01R 4/021 29/872
2005/0166394 A1 * 8/2005 Charron ..... H01R 9/032 29/860
2006/0048965 A1 * 3/2006 Ootsuki ..... H01R 4/22 174/74 A
2006/0169742 A1 * 8/2006 Fujimoto ..... H01R 4/187 228/4.5
2008/0230269 A1 * 9/2008 Susai ..... H01R 4/188 174/84 C
2011/0048762 A1 * 3/2011 Sawamura ..... B60R 16/0207 174/78
2011/0062218 A1 * 3/2011 Ohnuma ..... B23K 20/106 228/110.1
2011/0198122 A1 * 8/2011 Sagawa ..... H01R 4/023 174/84 R
2014/0284099 A1 * 9/2014 Saito ..... H01B 7/2825 174/70 R
2015/0076712 A1 * 3/2015 Cristaldi ..... H01L 24/45 257/779

FOREIGN PATENT DOCUMENTS

JP H0945380 A 2/1997
JP 2009-9736 1/2009
JP 2011-14438 A 1/2011

OTHER PUBLICATIONS

Notification of Reasons for Refusal dated Feb. 24, 2015, issued by the Japanese Patent Office in counterpart Japanese application No. 2011-135179.

* cited by examiner

INTER-WIRE CONNECTION STRUCTURE AND METHOD FOR MANUFACTURING THE SAME

CROSS REFERENCE TO RELATED APPLICATION

This application is based upon and claims the benefit of priority from the prior Japanese Patent Application No. 2011-135179, filed on Jun. 17, 2011, the entire contents of which are incorporated herein by reference.

BACKGROUND OF THE INVENTION

1. Field of the Invention

The present invention relates to an inter-wire connection structure for connecting cores of two wires, and a method for manufacturing the same.

2. Description of the Related Art

For example, in a case in which an aluminum wire is used as a wire, since a terminal is made of copper, connection to the terminal corresponds to a dissimilar metal joining. If water permeates a dissimilar metal joining portion, there is a concern about corrosion. Therefore, a corrosion prevention structure for a portion connected to the terminal is needed. The corrosion prevention structure for the portion connected to the terminal requires a change in a shape of the terminal, and a verification of reliability thereof or the like needs to be performed in each case. Therefore, it is very troublesome and incurs high-cost. Hence, there is proposed a structure that connects an end of an aluminum wire to a terminal through a short copper wire.

A related example of an inter-wire connection structure applied to such a structure is illustrated in FIG. 1 (see Japanese Unexamined Patent Application Publication No. 2009-9736). In FIG. 1, an end of an aluminum wire W1 is connected to a short copper wire W2 to which a terminal 140 is connected.

The aluminum wire W1 includes a core 101 and an insulating sheath section 102 sheathing the outer periphery of the core 101. The core 101 is configured by a plurality of twisted element wires 101*a*. At the end portion of the aluminum wire W1, the insulating sheath section 102 is stripped and the internal core 101 is exposed.

The copper wire W2 includes a core 111 and an insulating sheath section 112 sheathing the outer periphery of the core 111. The core 111 is configured by a plurality of twisted element wires 111*a*. At the end portion of the copper wire W2, the insulating sheath section 112 is stripped and the internal core 111 is exposed.

The exposed cores 101 and 111 of both the aluminum wire W1 and the copper wire W2 are joined together by ultrasonic welding or the like. Hence, a core joint section 121 is formed. Portions of the exposed cores 101 and 111 of both the aluminum wire W1 and the copper wire W2, and portions of the insulating sheath sections 102 and 112 located at both sides thereof are covered with a heat shrinkable tube 130.

According to the related example, since the connection portion of the terminal 140 is a connection between homogenous metals, corrosion due to water does not occur. Therefore, it is unnecessary to take corrosion prevention measures on the terminal 140.

The portions of connection to the aluminum wire W1 and the copper wire W2 (portions of the cores 101 and 111 exposed from the respective insulating sheath sections 102 and 112) are covered with the tightly-attached heat shrinkable tube 130. Therefore, the permeation of water into the core joint section 121 from the gap between the heat shrinkable tube 130 and the respective insulating sheath sections 102 and 112 may be prevented.

SUMMARY OF THE INVENTION

However, in the related inter-wire connection structure, there is a concern that water permeates the core joint section 121 due to the capillary phenomenon at the inside of the copper wire W2 from a terminal 140 side. Specifically, there is a concern that water permeates the core joint section 121 by capillary phenomenon at a gap between element wires 111*a* of the core 111, or a gap between the core 111 and the insulating sheath section 112, and corrosion due to the water occurs at the core joint section 121.

Particularly, as illustrated in FIG. 2, in the case in which the outer peripheral surface of the core joint section 121 has a substantially polygonal shape, it is highly likely that a gap d is formed between the core 111 and the heat shrinkable tube 130, and it is highly likely that water permeates the core joint section 121 by capillary phenomenon at the gap d.

Herein, there is a method for infiltrating a waterproof agent into the core 111 of the copper wire W2. However, in the infiltrated case, it is necessary to pressurize or depressurize an atmosphere to which the copper wire W2 or the like is set, and, on the contrary, it is necessary to depressurize an atmosphere to which the aluminum wire W1 or the like is set. Hence, facilities become large in scale, many processes are required, and therefore, it is not practical.

It is an object of the present invention to provide an inter-wire connection structure and a method for manufacturing the same, capable of easily and surely achieving a waterproofing to a core joint section and a corrosion prevention at the time of dissimilar metal joining.

A first aspect of the present invention is an inter-wire connection structure including: a first wire and a second wire connected to each other and each having a core sheathed with an insulating sheath section, the core including a plurality of element wires; a single-wire structure section in which the plurality of element wires of at least one of the cores exposed from the insulating sheath sections are made into a single wire; a core joint section in which both the cores exposed from the insulating sheath sections are joined at a position where an entire region of the single-wire structure section is not overlapped, the core joint section having an outer peripheral surface formed in a shape of a circumferential surface; and a tube configured to cover portions of both the cores exposed from the insulating sheath sections including the single-wire structure section and the core joint section, and portions of the insulating sheath sections located at both outsides of the corresponding portions of the cores, in a tightly attached state.

The first wire may be an aluminum wire, and the second wire may be a short copper wire having a portion connected to a terminal and located at a side opposite to a portion of connection to the aluminum wire.

The single-wire structure section may have an outer peripheral surface formed in a shape of a circumferential surface.

The single-wire structure section may have no gap between the element wires.

A second aspect of the present invention is a method for manufacturing an inter-wire connection structure for connecting a first wire and a second wire each having a core sheathed with an insulating sheath section, the core including a plurality of element wires, the method including:

performing a single-wire process on the plurality of element wires of at least one of the cores exposed from the insulating sheath sections to form a single-wire structure section; joining both the cores exposed from the insulating sheath sections at a position where an entire region of the single-wire structure section as formed is not overlapped to form a core joint section with an outer peripheral surface in a shape of a circumferential surface; and covering with a tube portions of both the cores exposed from the insulating sheath sections including the single-wire structure section as formed and the core joint section as formed, and portions of the insulating sheath sections located at both outsides of the corresponding portions of the cores, and shrinking the tube after covering.

The method may include: forming the first wire as an aluminum wire; and forming the second wire as a short copper wire having a portion connected to a terminal and located at a side opposite to a portion of connection to the aluminum wire.

Forming the single-wire structure section may include forming an outer peripheral surface of the single-wire structure section in a shape of a circumferential surface.

Forming the single-wire structure section may include forming no gap between the element wires in the single-wire structure section.

According to the above-described configuration, since each insulating sheath section and the tube are tightly attached, water does not permeate the core joint section from that gap. Further, there is a concern that water permeates toward the core joint section by capillary phenomenon at the inside of each wire. However, at a portion of a single-wire structure section, there is no gap between element wires, and therefore, water may not go through by capillary phenomenon. The permeation of water is dammed up at the position. Even if water permeates up to a position just in front of the core joint section, water does not permeate the portion of the core joint section because there is no gap between the outer peripheral surface of the core joint section and the inner peripheral surface of the tube. From the above, the waterproofing to the core joint section and the corrosion prevention at the time of dissimilar metal joining can be easily and surely achieved.

DETAILED DESCRIPTION OF THE EMBODIMENT

Hereinafter, an embodiment of the present invention will be described with reference to the drawings.

FIGS. 3 to 9 illustrate an embodiment of the present invention. An inter-wire connection structure of the embodiment is applied to a terminal connection structure that connects an end portion of an aluminum wire W1 to a terminal through a short copper wire W2. Hereinafter, the description will be given.

Figure 3A:
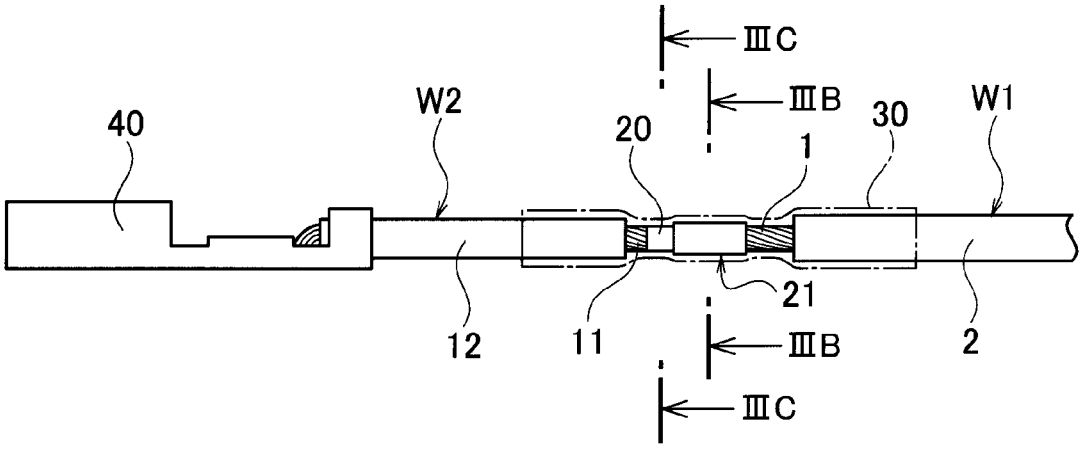
FIG. 3A is a perspective view of an inter-wire connection structure according to an embodiment of the present invention.
Figure 3B:
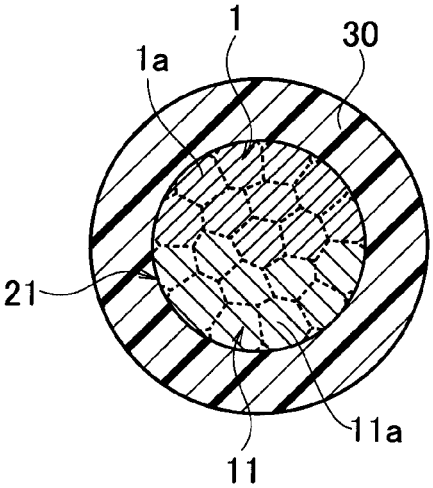
FIG. 3B is a cross-sectional view taken along line IIIB-IIIB of FIG. 3A.
Figure 3C:
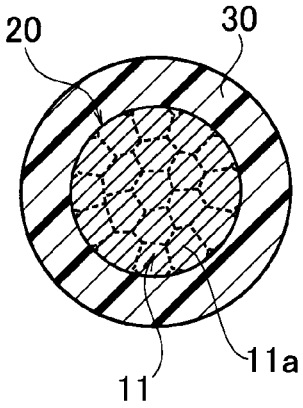
FIG. 3C is a cross-sectional view taken along line IIIC-IIIC of FIG. 3A.

In FIGS. 3A to 3C, the inter-wire connection structure includes an aluminum wire W1 being a first wire having a core 1, a copper wire W2 being a second wire connected to the aluminum wire W1, a single-wire structure section 20 formed in a core 11 of the copper wire W2, a core joint section 21 in which both the cores 1 and 11 are joined together, and a tube 30 covering both the exposed cores 1 and 11.

The aluminum wire W1 includes the core 1 and an insulating sheath section 2 sheathing the outer periphery of the core 1. The core 1 is configured by a plurality of twisted element wires 1*a* made of aluminum or an aluminum alloy. At the end portion of the aluminum wire W1, the insulating sheath section 2 is stripped and the internal core 1 is exposed.

The copper wire W2 is short as compared to the length of the aluminum wire W1. The copper wire W2 includes the core 11 and an insulating sheath section 12 sheathing the outer periphery of the core 11. The core 11 is configured by a plurality of twisted element wires 11*a* made of copper or a copper alloy. At one end side of the copper wire W2, the insulating sheath section 12 is stripped and the internal core 11 is exposed. At the other end side of the copper wire W2, the terminal 40 is connected.

The single-wire structure section 20, as illustrated in detail in FIG. 3C, the plurality of element wires 11*a* configuring the core 11 of the copper wire W2 are made into a single wire by bonder welding, ultrasonic welding, or the like. The outer peripheral surface of the single-wire structure section 20 is formed in a shape of a circumferential surface. At the portion of the single-wire structure section 20, there is no gap between the element wires 11*a*.

In the core joint section 21, both the cores 1 and 11 exposed from the insulating sheath sections 2 and 12, respectively, are joined by welding or the like at a position where at least a portion of the single-wire structure section 20 is not overlapped with the core 1 (i.e. only a part of the single-wire structure section 20 is overlapped with the core 1). The joining is performed by ultrasonic welding, bonder welding, cold pressure welding, or the like. Any joining method may be used as long as it can join both the cores 1 and 11. The outer peripheral surface of the core joint section 21, as illustrated in detail in FIG. 3B, is formed in a shape of a circumferential surface.

The tube 30 covers both the portions of the two cores 1 and 11 exposed from the insulating sheath sections 2 and 12 and the portions of the insulating sheath sections 2 and 12 located at both outsides thereof. The tube 30 is inexpensive and heat-shrinkable so that hot melt adhesive is not applied to the inner surface thereof. The inner surface of the heat-shrunk tube 30 is tightly attached to the entire circumferences of the core joint section 21, the single-wire structure section 20, other portions of each exposed core 1 and 11, and each outer peripheral surface of the insulating sheath sections 2 and 12 located at both outsides of the cores 1 and 11. There is no limitation to the tube 30 as long as the tube 30 has a structure that can be shrunk after being disposed at the outer periphery of the core joint section 21 or the like. For example, an ultraviolet curable tube may be used.

Figure 4A:
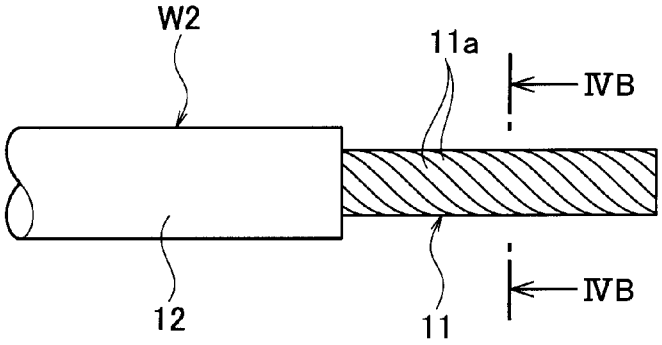
FIG. 4A is a front view illustrating a manufacturing process of an inter-wire connection structure according to an embodiment of the present invention.
Figure 4B:
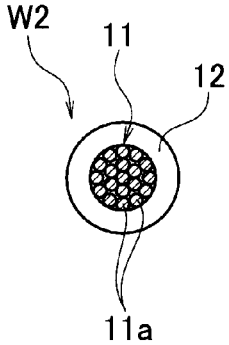
FIG. 4B is a cross-sectional view taken along line IVB-IVB of FIG. 4A.
Figure 5A:
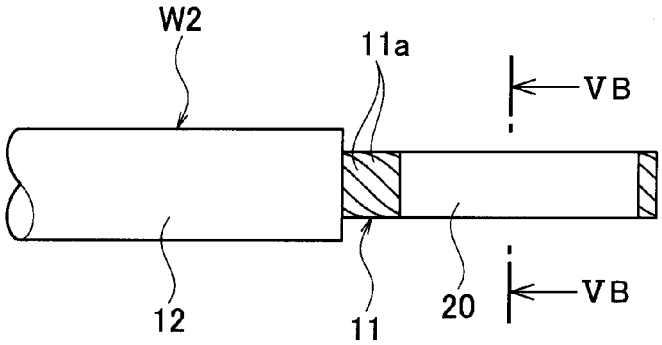
FIG. 5A is a front view illustrating a manufacturing process of an inter-wire connection structure according to an embodiment of the present invention.
Figure 5B:
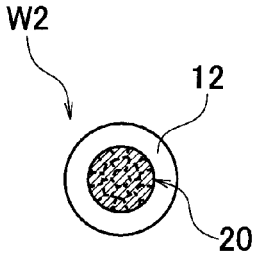
FIG. 5B is a cross-sectional view taken along line VB-VB of FIG. 5A.

Next, a method for manufacturing an inter-wire connection structure will be described. As illustrated in FIGS. 4A and 4B, a core 11 is exposed at an end of a copper wire W2. First, as illustrated in FIGS. 5A and 5B, a single-wire structure section 20 is formed at the exposed core of the copper wire W2 by bonder welding or the like (single-wire process).

Figure 6:
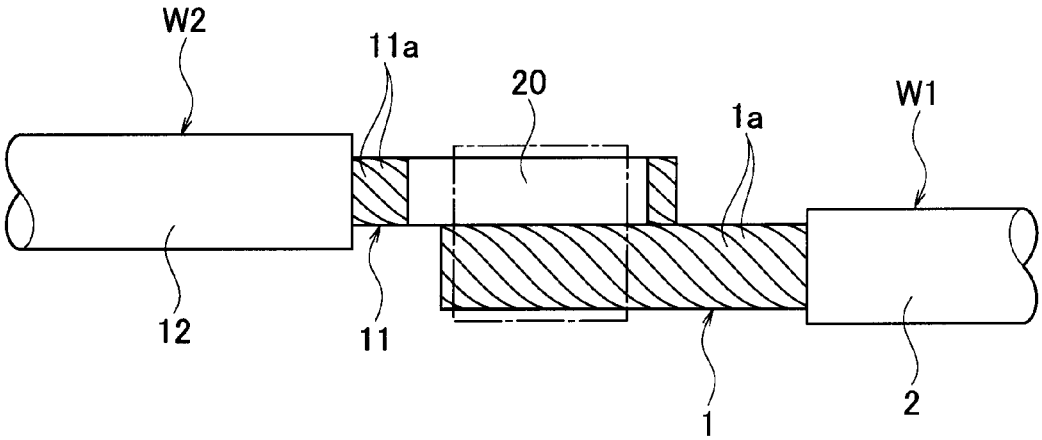
FIG. 6 is a front view illustrating a manufacturing process of an inter-wire connection structure according to an embodiment of the present invention.
Figure 7:
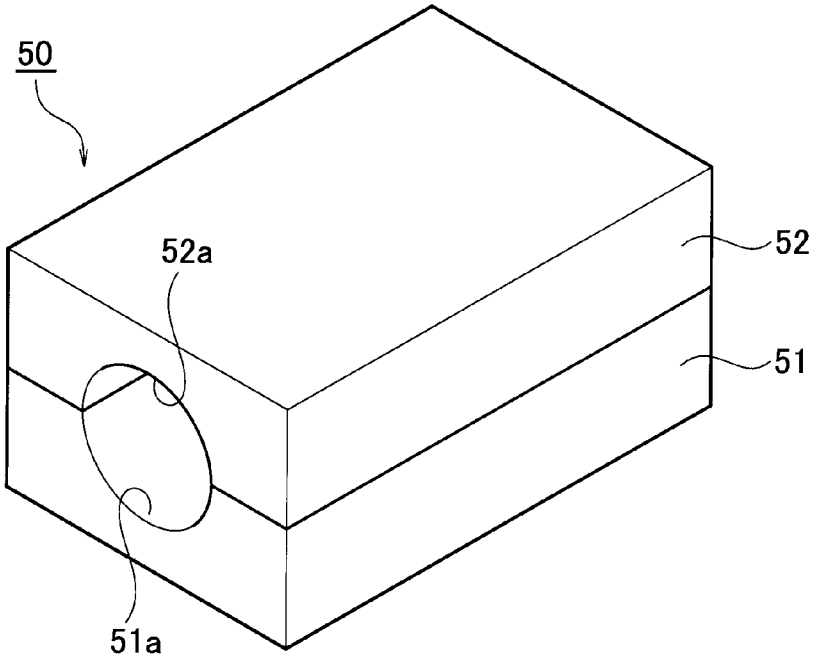
FIG. 7 illustrates an embodiment of the present invention and is a perspective view of main parts of an ultrasonic welding apparatus.
Figure 8:
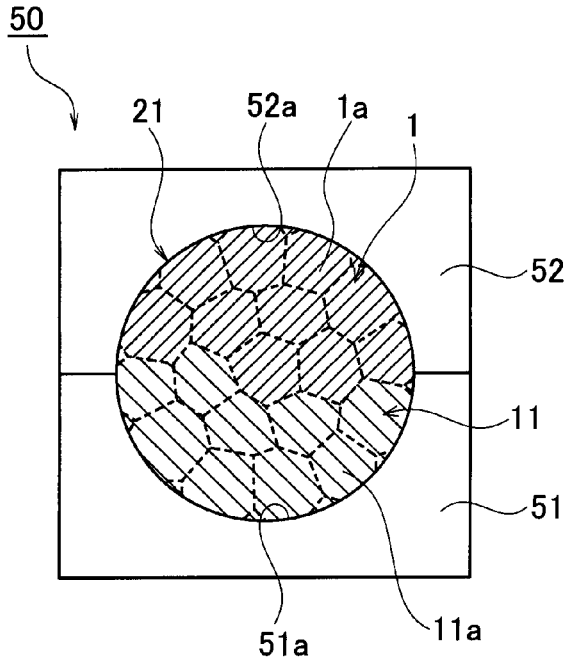
FIG. 8 illustrates an embodiment of the present invention and is a cross-sectional view illustrating an ultrasonic welded state.

Then, as illustrated in FIG. 6, exposed cores 1 and 11 of both an aluminum wire W1 and the copper wire W2 are joined together (core joining process). In the core joining process, an entire region of the single-wire structure section 20 of the exposed core 11 of the copper wire W2 is not joined, but a portion thereof is left at the outside. In the case of ultrasonic welding, the core joining process is performed using an ultrasonic welding apparatus 50. An anvil 51 and a horn 52 of the ultrasonic welding apparatus 50, as illustrated in FIG. 7, include core accommodation recess sections 51*a* and 52*a* having a semicircular arc shape at positions facing each other. Ultrasonic wave is applied for a predetermined time in such a state that the exposed cores 1 and 11 of both the aluminum wire W1 and the copper wire W2 are overlapped with each other within the core accommodation recess sections 51*a* and 52*a* of the anvil 51 and the horn 52. Then, as illustrated in FIG. 8, both the cores 1 and 11 are melted by ultrasonic energy, and a core joint section 21 is formed. The outer peripheral surface of the core joint section 21 is a circumferential surface due to the shapes of the core accommodation recess sections 51*a* and 52*a* of the anvil 51 and the horn 52.

Figure 9:
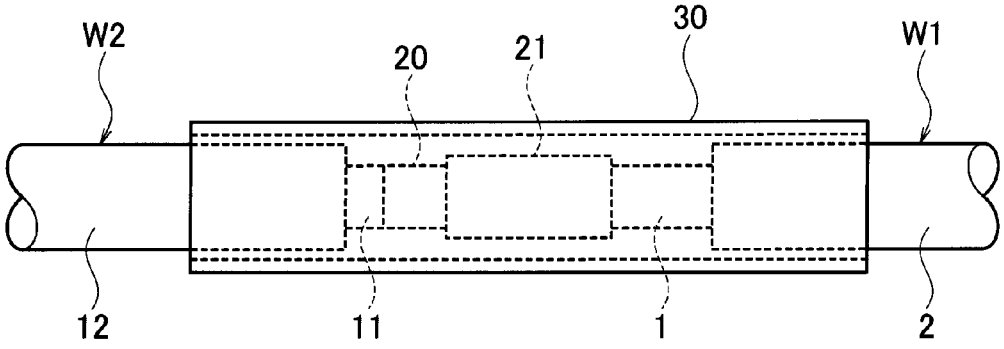
FIG. 9 is a front view illustrating a manufacturing process of an inter-wire connection structure according to an embodiment of the present invention.

Then, the core joint section 21, the single-wire structure section 20, other portions of both the cores 1 and 11, and the outer periphery of the insulating sheath sections 2 and 12 of both sides thereof, are covered with a tube 30 (tube covering process). Specifically, in the tube covering process, as illustrated in FIG. 9, the tube 30 having a predetermined width is disposed at, for example, the outside of the core joint section 21 or the like. Then, the tube 30 is shrunk by applying heat thereto. Due to the heat shrinkage, the tube 30 is tightly attached to the outer periphery of the core joint section 21 or the like.

In the inter-wire connection structure manufactured in this manner, since the respective insulating sheath sections 2 and 12 and the tube 30 are tightly attached, water does not permeate the tube 30 from the gap therebetween. There is a concern that water having permeated the copper wire W2 from the terminal 40 side permeates toward the core joint section 21 due to the capillary phenomenon caused by the gap between the element wires 11*a* of the core 11 or the gap between the outer peripheral surface of the core 11 and the inner peripheral surface of the tube 30. Herein, at the portion of the single-wire structure section 20, there is no gap between the element wires 11*a*, and therefore, water may not go through by capillary phenomenon. The permeation of water is dammed up at this position. Even if water permeates up to a position just in front of the core joint section 21, water may not permeate the portion of the core joint section 21 because there is no gap between the outer peripheral surface of the core joint section 21 and the inner peripheral surface of the tube 30. From the above, the waterproofing to the core joint section 21 and the corrosion prevention at the time of dissimilar metal joining (in the case of the embodiment) may be easily and surely achieved.

Figure 1:
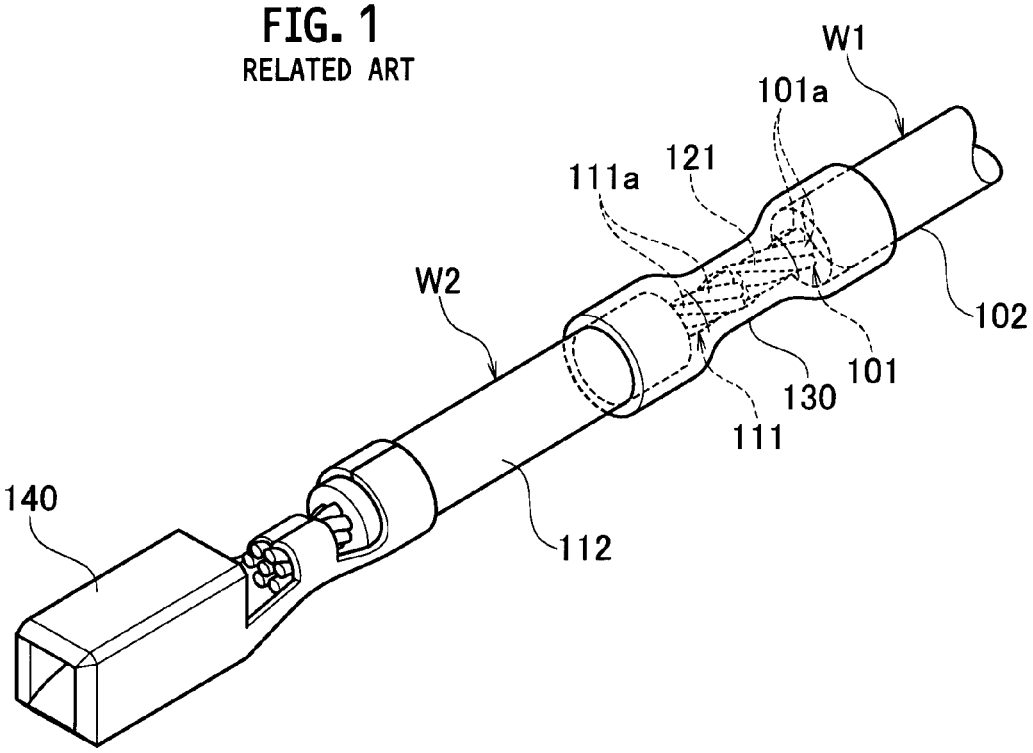
FIG. 1 RELATED ART
FIG. 1 is a perspective view of a related inter-wire connection structure.
Figure 2:
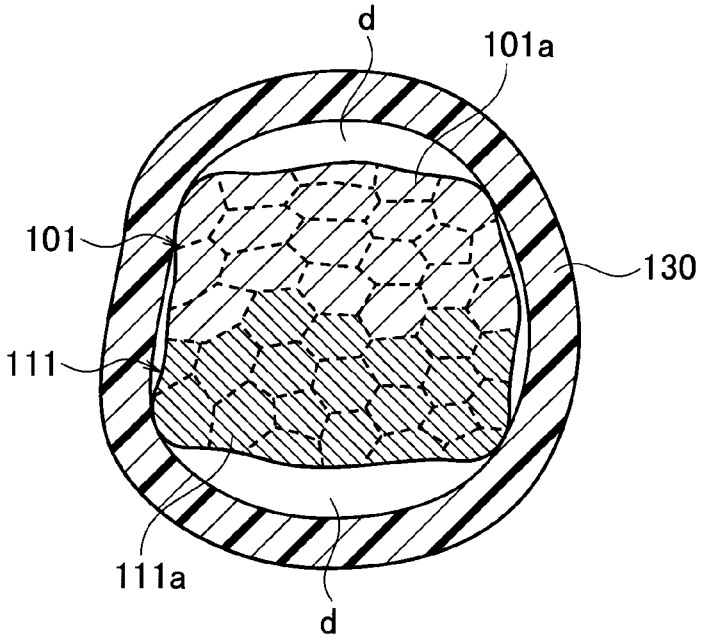
FIG. 2 RELATED ART
FIG. 2 is a cross-sectional view of the related inter-wire connection structure.

The outer peripheral surface of the core joint section is formed in a shape of a circumferential surface. Therefore, the tube 30 is equally shrunk over the entire circumference of the core joint section 21. Hence, due to the contractile force of the tube 30 alone, as illustrated in FIG. 2, no gap is formed and the tube 30 is tightly attached to the entire circumference of the outer peripheral surface of the core joint section 21. Therefore, the shrinkage sealing can be achieved by the inexpensive tube, without hot melt adhesive.

The outer peripheral surface of the single-wire structure section 20 is formed in a shape of the circumferential surface. Therefore, at the portion of the single-wire structure section 20, the tube 30 is equally shrunk over the entire circumference of the single-wire structure section 20. Due to the contractile force alone, the tube 30 is tightly attached to the entire circumference, and thus, there is no gap between the outer peripheral surface of the single-wire structure section 20 and the inner peripheral surface of the tube 30. Hence, permeation of water from the gap between the outer peripheral surface of the single-wire structure section 20 and the inner peripheral surface of the tube 30 may be prevented. That is, the single-wire structure section 20 may prevent both the permeation of water from the gap between the element wires 11*a* of the core 11 and the permeation of water from the gap between the outer peripheral surface of the single-wire core 11 and the inner peripheral surface of the tube 30.

Although the first wire is the aluminum wire W1 and the second wire is the copper wire W2, other various types of dissimilar metals may also be connected. Further, the present invention may also be applied to the connection between homogeneous metals, such as between the aluminum wires W1 or between the copper wires W2. In the case of the connection between the homogeneous metals, corrosion due to permeation of water may not be occurred, but an inter-wire connection structure having a reliable waterproofing effect to the core joint section 21 may be provided.

The copper wire W2 is a short wire to which the terminal 40 is connected at the side opposite to the portion of connection to the aluminum wire W1. Therefore, the waterproofing and corrosion prevention measures may be easily taken as compared to the case in which the waterproofing and corrosion prevention measures are taken at the portion of connection to the terminal 40. Therefore, since it is unnecessary to take the waterproofing and corrosion prevention measures at the portion of connection to the terminal 40, the waterproofing and corrosion prevention effect may be maintained even though the shape of the terminal 40 is changed. Since it is unnecessary to take the waterproofing and corrosion prevention measures at the portion of connection to the terminal 40, there is no obstacle to the insertion of the terminal 40 into a housing (not illustrated), or the like.

In the core joining process of the embodiment, although the cores 1 and 11 are joined at the position where at least a portion of the single-wire structure section 20 of the exposed core 11 of the copper wire W2 is not overlapped with the core 1, the cores 1 and 11 may also be joined at the position where the single-wire structure section 20 is not entirely overlapped with the core 1.

In the embodiment, although the single-wire structure section 20 is formed at only the core 11 of the copper wire W2 in order to prevent the permeation of water from the short copper wire W2 side, the single-wire structure section 20 may also be formed at the core 1 of the aluminum wire W1 if it is necessary to prevent the permeation of water from the aluminum wire W1 side. That is, if there is a concern about the permeation of water at both the first wire and the second wire, the single-wire structure section 20 may be formed at both the cores 1 and 11. If there is a concern about the permeation of water only at either of the first wire or the second wire, the single-wire structure section 20 may be formed at only the concerned core 1 or 11 side.

Although the present invention has been described above by reference to the embodiment, the present invention is not limited to those and the configuration of parts can be replaced with any configuration having a similar function.

What is claimed is:

1. A method for manufacturing an inter-wire connection structure for connecting a first wire and a second wire, the first wire including a first core formed by a plurality of first wire elements and a first insulating sheath surrounding the first core, and the second wire including a second core formed by a plurality of second wire elements and a second insulating sheath surrounding the second core, the method comprising:

exposing a portion of the first core and the second core from the first insulating sheath and the second insulating sheath, respectively;

performing a single-wire process on the plurality of first wire elements of the first core exposed to form a single-wire structure section in which the first wire elements are joined together;

joining the single-wire structure section of the first core exposed and the second core exposed to form a core joint section having an outer peripheral surface formed in a continuously circular shape such that at least a portion of the single-wire structure section as formed extends outside of the core joint section wherein the portion of the single-wire structure section is left at the outside of the core joint section; and covering the first core exposed and the second core exposed with an insulating tube including the single-wire structure section of the first core as formed and the core joint section of the first core and the second core as formed, and further covering portions of the insulating sheath located at both outsides of the first core exposed and the second core exposed with the insulating tube, and shrinking the insulating tube after covering, wherein the insulating tube directly contacts at least the first core and the second core of the core joint section with no spacing therebetween;

wherein forming the single-wire structure section comprises forming an outer peripheral surface of the single-wire structure section in a continuously circular shape; and wherein at least an outer portion of the first wire and at least an outer portion of the second wire are formed from different materials.

2. The method according to claim 1, comprising:

forming the first wire as an aluminum wire; and forming the second wire as a short copper wire having a portion connected to a terminal and located at a side opposite to a portion of connection to the aluminum wire.

3. The method according to claim 1, wherein forming the single-wire structure section comprises forming no gap between the first wire elements in the single-wire structure section.

4. The method according to claim 1, wherein the single-wire structure section is formed in the first core of the first wire, and the extended single-wire structure section is disposed between the first core joint section and the plurality of element wires of the core of the first wire.

5. The method according to claim 4, further comprising:

performing a single-wire process on the plurality of element wires of the second core of the second wire to form a single-wire structure section of the second wire.

6. The method according to claim 1, wherein the first wire is formed of aluminum and the second wire is formed of copper.

7. The method according to claim 1, wherein the first wire and the second wire are formed from entirely of different materials.

8. The method according to claim 1, wherein a portion of the first wire in contact with a portion of the second wire at the core joint section is formed of an entirely different material than the portion of the second wire.

* * * * *